US009302443B2

(12) United States Patent
Yabune

(10) Patent No.: US 9,302,443 B2
(45) Date of Patent: Apr. 5, 2016

(54) SEALING SYSTEM FOR CREATING SEALED LETTER BY USE OF ENVELOPE SHEET WITH BOND PART

(71) Applicant: Riso Kagaku Corporation, Tokyo (JP)

(72) Inventor: Hirokazu Yabune, Ibaraki-ken (JP)

(73) Assignee: RISO KAGAKU CORPORATION, Tokyo (JP)

( * ) Notice: Subject to any disclaimer, the term of this patent is extended or adjusted under 35 U.S.C. 154(b) by 575 days.

(21) Appl. No.: 13/765,270

(22) Filed: Feb. 12, 2013

(65) Prior Publication Data

US 2013/0225384 A1 Aug. 29, 2013

(30) Foreign Application Priority Data

Feb. 23, 2012 (JP) ..... 2012-037307

(51) Int. Cl.

| | |
|---|---|
| ***G06F 7/00*** | (2006.01) |
| ***B31B 1/88*** | (2006.01) |
| ***B31B 39/00*** | (2006.01) |
| ***B43M 5/04*** | (2006.01) |

(52) U.S. Cl.

CPC ..... *B31B 39/00* (2013.01); *B43M 5/047* (2013.01)

(58) Field of Classification Search

None

See application file for complete search history.

(56) References Cited

U.S. PATENT DOCUMENTS

2011/0154778 A1 6/2011 Oshio et al.
2013/0260977 A1* 10/2013 Wakatabi ..... B65D 27/14 493/188

FOREIGN PATENT DOCUMENTS

| | | |
|---|---|---|
| GB | 2224569 | 5/1990 |
| JP | 2-147546 | 6/1990 |
| JP | 3-238578 | 10/1991 |
| JP | 5-92841 | 4/1993 |
| JP | 10-273109 A | 10/1998 |
| JP | 2001-301723 | 10/2001 |
| JP | 2011-131924 | 7/2011 |

OTHER PUBLICATIONS

Official Action for JP App. No. 2012-037307 having an issuance date of Nov. 17, 2015.

* cited by examiner

*Primary Examiner* — Yolanda Cumbess
(74) *Attorney, Agent, or Firm* — Greenblum & Bernstein, P.L.C.

(57) ABSTRACT

A sealing system for creating a sealed letter by use of an envelope sheet with a bond part on a basis of a sealing setting. The sealing system includes a transmission amount detector configured to detect an amount of transmission of the envelope sheet being conveyed on a conveyance path, a bond position calculator configured to calculate a first bond position where the bond part exists in the envelope sheet on a basis of the amount of transmission as detected by the transmission amount detector, and a judgment unit configured to judge whether the envelope sheet is conveyed a correct way round in a conveyance direction of the envelope sheet, from the first bond position as calculated by the bond position calculator and a second bond position based on the sealing setting.

10 Claims, 5 Drawing Sheets

SEALING SYSTEM FOR CREATING SEALED LETTER BY USE OF ENVELOPE SHEET WITH BOND PART

CROSS REFERENCE TO RELATED APPLICATION

This application is based upon and claims the benefit of priority from the prior Japanese Patent Application No. 2012-037307, filed on Feb. 23, 2012, the entire contents of which are incorporated herein by reference.

BACKGROUND

1. Technical Field

The present disclosure relates to a sealing system for automatically creating a sealed letter by use of an envelope sheet with a bond part.

2. Related Art

A printing machine is commonly well-known, which carries out color printing on a print sheet delivered from a paper feed tray by ejecting ink from ink-jet heads on the basis of image data.

There is an enclosing and sealing apparatus which is connected to such a printing machine and configured to: create an envelope by folding an envelope sheet printed by the printing machine; fold enclosure sheets, which are printed by the printing machine, so that the sheets can be enclosed in the created envelope; and seal the envelope in which the sheets are enclosed.

Japanese patent application publication No. Hei 10-273109 discloses an enclosing and sealing apparatus for enclosing and sealing an address sheet and a subsequent data sheet.

SUMMARY

However, when enclosing and sealing the address sheet and the subsequent data sheet (hereinafter referred to as "enclosure") in an envelope, the enclosing and sealing apparatus described in Japanese patent application publication No. Hei 10-273109 may fail in carrying out the enclosing and sealing processing properly if the envelope sheet is wrongly placed. This is because a position where a bond part exists in the envelope sheet (hereinafter referred to as "bond position") is located at an improper position.

To be more specific, if the envelope sheet is the wrong way round in a conveyance direction of the envelope sheet, the enclosing and sealing apparatus cannot carry out enclosing and sealing processing properly because the bond position is displaced from the proper position in the enclosing and sealing. Moreover, the enclosing and sealing processing with the bond position wrongly located results in a waste of a valuable envelope sheet.

An object of the present invention is to provide a sealing system which judges whether or not the bond position of an envelope sheet is located at a proper position.

A sealing system for creating a sealed letter by use of an envelope sheet with a bond part on a basis of a sealing setting in accordance with some embodiments includes a transmission amount detector configured to detect an amount of transmission of the envelope sheet being conveyed on a conveyance path, a bond position calculator configured to calculate a first bond position where the bond part exists in the envelope sheet on a basis of the amount of transmission as detected by the transmission amount detector, and a judgment unit configured to judge whether the envelope sheet is conveyed a correct way round in a conveyance direction of the envelope sheet, from the first bond position as calculated by the bond position calculator and a second bond position based on the sealing setting.

According to the above configuration, the bond position calculator calculates the bond position of the envelope sheet where the bond part exists on the basis of the amount of transmission detected by the transmission amount detector, and then the judgment unit judges whether or not the envelope sheet is conveyed the correct way round from the calculated bond position and the bond position based on the sealing setting. This makes it possible to judge whether or not the bond position of the envelope sheet is properly positioned and thus to prevent a waste of an envelope sheet.

The bond position calculator may be configured to calculate the first bond position by adding up amounts of transmission as detected by the transmission amount detector in each of regions into which the envelope sheet is divided in the conveyance direction.

According to the above configuration, the amounts of transmission detected by the transmission amount detector are added up in each of the regions into which the envelope sheet is divided in the conveyance direction. Thereby, the bond position is calculated. This enables more exact calculation of the bond position in addition to the aforementioned effect.

The judgment unit may be configured to judge whether the second bond position based on the sealing setting and the first bond position calculated by the bond position calculator are located in symmetrical positions against a center of the envelope sheet in the conveyance direction.

According to the above configuration, the judgment unit also judges whether or not the bond position calculated by the bond position calculator and the bond position based on the sealing setting are symmetric to each other in the conveyance direction. This enables judgment on whether or not an envelope sheet is the wrong way round in the conveyance direction of the envelope sheet, and also enables more proper notification to the user by use of this judgment result.

The bond position calculator may be configured to calculate the first bond position by calculating, as a detected sheet thickness, a thickness of each of regions into which the envelope sheet is divided in the conveyance direction, on a basis of the amount of transmission as detected by the transmission amount detector.

According to the above configuration, more exact calculation of the bond position can be performed.

BRIEF DESCRIPTION OF DRAWINGS

FIG. 4A shows how an envelope sheet conveyed the correct way round is divided into regions; FIG. 4B shows a normal sheet thickness in the case of FIG. 4A; FIG. 4C shows how an envelope sheet conveyed the wrong way round is divided into regions; and FIG. 4D shows a detected sheet thickness in the case of FIG. 4C.

FIG. 5A shows how an envelope sheet conveyed the correct way round is divided into regions; FIG. 5B shows a normal sheet thickness in the case of FIG. 5A; FIG. 5C shows how an envelope sheet conveyed the wrong way round is divided into regions; and FIG. 5D shows a detected sheet thickness in the case of FIG. 5C.

DETAILED DESCRIPTION

Figure 1:
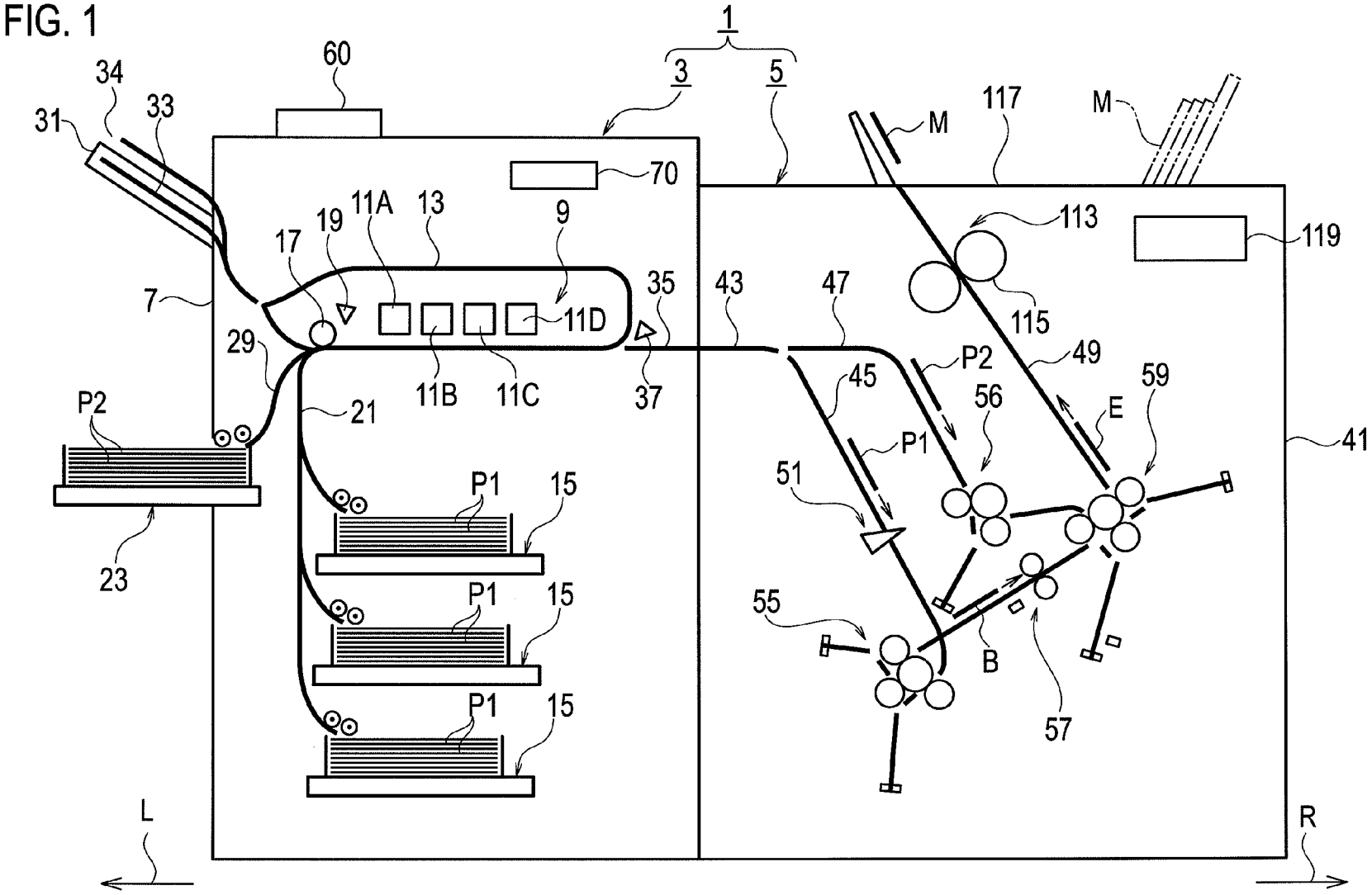
FIG. 1 is a schematic front view of an enclosing and sealing system according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Hereinbelow, an embodiment of the present invention is described.

The embodiment of the present invention is described by exemplifying an enclosing and sealing system including: an image forming apparatus configured to carry out color printing on a print sheet conveyed from a paper feed tray; and an enclosing and sealing apparatus configured to fold enclosure sheets on which printing is made by the image forming apparatus and to enclose these sheets in envelopes.

(Configuration of Image Forming Apparatus)

A description is now given of the configuration of the enclosing and sealing apparatus according to the embodiment of the present invention. It should be noted, throughout the description, that the term "upstream" indicates upstream as seen in a conveyance direction T (the arrow T) in which enclosure sheets or the like are conveyed, and the term "downstream" indicates downstream as seen in the conveyance direction T, and that, in FIG. 1, the arrow "L" indicates leftwards as seen from the front and the arrow "R" indicates rightwards as seen from the front.

FIG. 1 is a schematic front view of the enclosing and sealing system according to the embodiment of the present invention.

As shown in FIG. 1, an enclosing and sealing system 1 according to the embodiment of the present invention includes: an image forming apparatus 3 which is a print sheet judging device; and an enclosing and sealing apparatus 5 being adjacent to and connected to a downstream part of the image forming apparatus 3.

The image forming apparatus 3 carries out single-sided or double-sided printing on each of enclosure sheets P1 and/or envelope sheets P2 on the basis of enclosing and sealing settings instructed by the user. The device 3 then passes the printed sheets to the adjacent enclosing and sealing apparatus 5.

Upon reception of the printed enclosure sheets P1 and/or envelope sheets P2 from the image forming apparatus 3, the enclosing and sealing apparatus 5 makes enclosures B from the enclosure sheets P1 and envelopes E from the envelope sheets P2 on the basis of the enclosing and sealing settings. Then, when the enclosures B exist, the enclosing and sealing apparatus 5 seals each envelope E with an enclosure B enclosed in the envelope, and creates letters M. Here, a letter M is sometimes an envelope E having no enclosure B in it. In this case, the contents which would otherwise be printed on the enclosure B is printed on the back side of the envelope E. Also, in this case, since there is no enclosing process, the enclosing and sealing system 1, the enclosing and sealing apparatus 5, the enclosing and sealing settings, an enclosing and sealing job (described below), and a chassis for enclosing and sealing unit 41 (described below) can be called a sealing system, a sealing apparatus, sealing settings, a sealing job, and a chassis for sealing unit, respectively.

The image forming apparatus 3 includes, in its chassis, an ink-jet printing unit 9 configured to carry out printing on enclosure sheets P1 and envelope sheets P2. The printing unit 9 has multiple line-shaped ink heads 11A, 11B, 11C, 11D configured to eject ink of black, cyan, magenta and yellow, respectively. A printing conveyance path 13 for conveying the enclosure sheets P1 and the envelope sheets P2 is provided surrounding the printing unit 9.

In the chassis of the image forming apparatus 3, multiple enclosure sheet feeders 15 are provided below the printing unit 9 in a way that forms a staircase pattern vertically. The enclosure sheet feeders 15 are configured to feed the enclosure sheets P1 toward the printing unit 9 (toward the printing conveyance path 13) one by one.

A sheet conveying path 21 for conveying enclosure the sheets P1 toward the printing unit 9 is provided in a left part in the chassis of the image forming apparatus 3. The sheet conveying path 21 conveys the enclosure sheets P1 fed from the enclosure sheet feeders 15.

An envelope sheet feeder 23 is provided on the left side in the chassis of the image forming apparatus 3. The envelope sheet feeder 23 is configured to feed the envelope sheets P2 toward the printing unit 9 (toward the printing conveyance path 13).

A sheet conveying path 29 for conveying the envelope sheets P2 toward the printing unit 9 is provided in the left part in the chassis of the image forming apparatus 3. The sheet conveying path 29 conveys the envelope sheets P2 fed from the envelope sheet feeder 23.

A paper stop roller 17 is provided downstream of the junction between the sheet conveying paths 21, 29. The paper stop roller 17 adjusts the orientation of each of the enclosure sheets P1 conveyed on the sheet conveying path 21 or each of the envelope sheets P2 conveyed on the sheet conveying path 29 when the sheet bumps into the roller. The sheet subjected to the adjustment by the paper stop roller 17 is conveyed to the printing unit 9 on the printing conveyance path 13.

A transmission amount sensor 19 is provided downstream of the paper stop roller 17. The transmission amount sensor 19 is configured to detect the amounts of transmission of each envelope sheet P2 conveyed on the conveyance path. The transmission amount sensor 19, for example, irradiates the envelope sheet P2 with light by use of a phototransmitter and receive the light transmitted through the envelope sheet P2 by use of a photoreceiver to measure the amount of the transmitted light. In this case, the amount of the transmitted light through a bond part (described below) of the envelope sheet P2 is much less than that through the rest of the envelope sheet P2. The transmission amount sensor 19 may irradiate the envelope sheet P2 with infrared ray, radial ray, or the like instead of light.

A cassette 31 for temporarily housing each of the enclosure sheets P1 and the envelope sheets P2 is provided above the left side of the printing conveyance path 13. A switchback conveyance path 33 extends from the left of the chassis of the image forming apparatus 3 to the inside of the cassette 31. The switchback conveyance path 33 is a path for turning each of the enclosure sheets P1 and the envelope sheets P2 over and conveying it toward the printing unit 9. A paper discharge tray 34 to which sheets are discharged without being reversed is provided above the cassette 31.

Each of the enclosure sheets P1 and the envelope sheets P2 can be subjected to double-sided printing by being turned over on the switchback conveyance path 33 before conveyed toward the printing unit 9 as described above.

A connecting conveyance path 35 is provided in a right part in the chassis of the image forming apparatus 3. The connecting conveyance path 35 is a path for conveying each of the enclosure sheets P1 and the envelope sheets P2 delivered on the printing conveyance path 13 toward the enclosing and sealing apparatus 5 (to the right).

A switch mechanism 37 is provided to one end part of the connecting conveyance path 35. The switch mechanism 37 is configured to switch a subsequent path for each of the enclosure sheets P1 and the envelope sheets P2 between the connecting conveyance path 35 toward the enclosing and sealing apparatus 5 (to the right) and the printing conveyance path 13 for circulation.

A controller 70 is provided at a proper position in the chassis of the image forming apparatus 3. The controller 70 is configured to control the operations of the printing unit 9, the enclosure sheet feeder 15, the envelope sheet feeder 23, a manipulation unit 60, and the like.

As shown in FIG. 1, the enclosing and sealing apparatus 5 of the enclosing and sealing system 1 includes a chassis for enclosing and sealing unit 41 (hereinafter referred to as "apparatus chassis 41" as needed). The apparatus chassis 41 includes an inlet conveyance path 43 for conveying, to the right, each of the enclosure sheets P1 and the envelope sheets P2 which is subjected to printing and delivered on the connecting conveyance path 35 (from the image forming apparatus 3).

The apparatus chassis 41 of the enclosing and sealing apparatus 5 includes an enclosure sheet conveying path 45 for conveying the printed enclosure sheets P1 and the like (including the enclosures B). Further, in the apparatus chassis 41, an envelope sheet conveying path 47 for conveying the printed envelope sheets P2 is provided above the enclosure sheet conveying path 45, and a controller 119 for controlling the enclosing and sealing apparatus 5 is provided at a proper position.

The downstream end of the enclosure sheet conveying path 45 and the downstream end of the envelope sheet conveying path 47 join at an envelope forming unit 59. In the apparatus chassis 41, an envelope conveying path 49 is provided on the downstream side (outlet side) of the junction between the enclosure sheet conveying path 45 and the envelope sheet conveying path 47. The envelope conveying path 49 is a path for conveying the envelopes E and the like (including the letters M) with the enclosures B enclosed in the respective envelopes E. The envelope conveying path 49 extends to an upper part of the apparatus chassis 41.

An alignment unit 51 is provided in a halfway position in the enclosure sheet conveying path 45. The alignment unit 51 stacks and aligns the printed enclosure sheets P1 delivered on the inlet conveyance path 43.

An enclosure forming unit 55 is provided in a part of the enclosure sheet conveying path 45 which is on the side of the outlet of the alignment unit 51 (downstream of the alignment unit 51). The enclosure forming unit 55 is configured to fold the enclosure sheets P1 aligned by and delivered from the alignment unit 51 (such enclosure sheets are also referred to as enclosure sheets P1 as needed) to form an enclosure B.

A pre-folding unit 56 is provided in a halfway position in the envelope sheet conveying path 47. The pre-folding unit 56 is configured to pre-fold the printed envelope sheets P2 (such an envelope sheet are also referred to as envelope sheet P2 as needed) delivered on the connecting conveyance path 35.

The envelope forming unit 59 is provided at the junction between the enclosure sheet conveying path 45 and the envelope sheet conveying path 47. The envelope forming unit 59 is configured to fold the envelope sheets P2 delivered from the pre-folding unit 56 to form the envelopes E.

An enclosure delivering unit 57 is provided in a halfway position in the enclosure sheet conveying path 45, and on the side of the inlet of the envelope forming unit 59 (upstream of the envelope forming unit 59). The enclosure delivering unit 57 is configured to deliver the enclosures B delivered from the enclosure forming unit 55 toward the envelope forming unit 59 so that the enclosures B can be enclosed in the corresponding envelope sheets P2 in the folding process along a fold line P2*b*.

A sealing unit 113 is provided in a halfway position in the envelope conveying path 49. The sealing unit 113 is configured to seal the envelopes E delivered from the envelope forming unit 59. The sealing unit 113 includes a pair of sealing rollers 115 configured to pinch and press the envelopes E therebetween. The pair of sealing rollers 115 can be rotated by the drive of a sealing motor (not illustrated) provided as needed. Here, each envelope E is designed to be sealed by being pinched and pressed by the pair of sealing rollers 115, by use of the adhesiveness of a pressure-sensitive adhesive and/or a liquid glue applied on the envelope sheet P2 in advance.

A letter discharging unit 117 is provided downstream of the envelope conveying path 49. The letter discharging unit 117 is configured to discharge letters M normally sealed and delivered on the envelope conveying path 49.

As described above, the image forming apparatus 3 carries out printing on the enclosure sheets P1 and the envelope sheets P2. The enclosing and sealing apparatus 5 creates the letters M by: forming the enclosures B from the printed enclosure sheets P1 delivered from the image forming apparatus 3; forming the envelopes E by folding the envelope sheets P2; and sealing the envelopes E with the enclosures B enclosed in the envelopes E by use of the adhesiveness of the pressure-sensitive adhesive and/or the liquid glue applied on the envelope sheets P2 in advance.

Due to such configurations, it is impossible to create the letters M properly if the pressure-sensitive adhesive and/or the liquid glue applied on the envelope sheets P2 in advance are not situated at their respective proper positions because, for example, the envelope sheets P2 delivered from the image forming apparatus 3 are the wrong way round in the conveyance direction T.

Against this background, in the enclosing and sealing system 1 according to the embodiment of the present invention, the image forming apparatus 3 judges whether a position of each envelope sheet P2 to be bonded (hereinafter referred to as a "bond position" as needed) is located properly or not on the basis of the enclosing and sealing settings before passing the envelope sheet P2 to the enclosing and sealing apparatus 5.

It should be noted that the image forming apparatus 3 of the enclosing and sealing system 1 according to the embodiment of the present invention is applicable to sheets of any size. Although the following embodiment is described, for example, based on the assumption that the printing is performed by ink-jet, the printing may be performed by a different printing method, and no specific restriction is imposed on the type of printing. In addition, the number of types of printed sheets to be sealed (the number of printed sheets) is not particularly limited either.

(Functional Configuration of Image Forming Apparatus 3)

Next, a description is given of the functional configuration of the image forming apparatus 3 according to the embodiment of the present invention.

Figure 2:
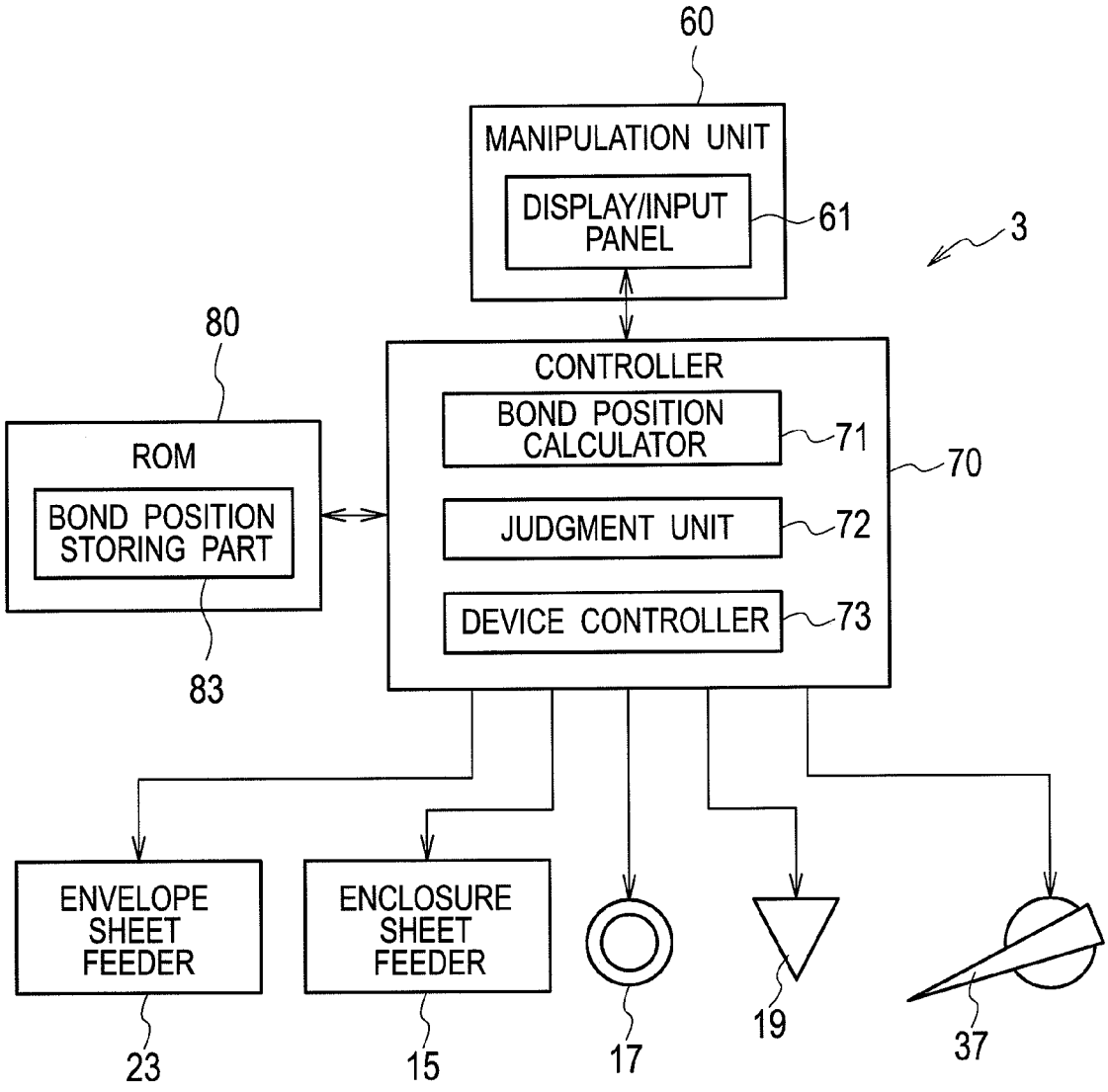
FIG. 2 is a diagram showing the functional configuration of an image forming apparatus according to the embodiment of the present invention.

FIG. 2 is a diagram showing the functional configuration of the image forming apparatus 3 according to the embodiment of the present invention.

As shown in FIG. 2, the image forming apparatus 3 includes: the envelope sheet feeder 23; the enclosure sheet feeder 15; the paper stop roller 17; the transmission amount sensor 19; the switch mechanism 37; a ROM 80; the manipulation unit 60; and the controller 70. Among these constituents, the envelope sheet feeder 23, the enclosure sheet feeder 15, the paper stop roller 17, the transmission amount sensor 19, and the switch mechanism 37 have been described previously and thus a description thereof is omitted.

The manipulation unit 60 includes: a display/input panel 61 and various manipulation keys (none of which is illustrated) such as a start key for starting reading, printing, and the like; a stop key for stopping reading, printing, and the like; and a figure keypad for inputting the number of sheets to be printed and the like. The manipulation unit 60 is configured to send the controller 70 manipulation signals based on the user's manipulation.

The display/input panel 61 of the manipulation unit 60 includes: a pressure-sensitive or electrostatic transparent touchscreen placed on the front surface of the display/input panel 61; and a liquid crystal display panel placed on the back surface of the touchscreen and configured to display a screen such as an error display screen for displaying an error message (although neither the touchscreen nor the liquid crystal display panel is illustrated). The user can press various buttons by touching the front surface of the touchscreen directly with a finger or the like while looking at a screen displayed on the liquid crystal display panel.

The ROM 80 is made from a nonvolatile semiconductor or the like, and stores therein, for example, various control programs executed by the controller 70. The ROM 80 includes a bond position storing part 83 in a part of a storage area.

The bond position storing part 83 stores, as a normal sheet thickness, a thickness of each of regions into which the envelope sheet P2 is divided in the conveyance direction T, when the envelope sheet P2 is conveyed the correct way round in the conveyance direction T (i.e. when the envelope sheet P2 is conveyed with the correct orientation with respect to the anteroposterior direction of the envelope P2) as set based on the enclosing and sealing settings by the user. Note that the bond position storing part 83 may store a bond position of a bond part of the envelope sheet P2 which is conveyed the correct way round as set based on the enclosing and sealing settings by the user.

The controller 70 performs central control over the image forming apparatus 3. The controller 70 has functional blocks including a bond position calculator 71, a judgment unit 72, and a device controller 73.

The bond position calculator 71 is configured to calculate a bond position where a bond part of an envelope sheet P2 exists on the basis of the amounts of transmission detected by the transmission amount sensor 19. To be more specific, the bond position calculator 71 calculates, as a detected sheet thickness, a thickness of each of the regions into which the envelope sheet P2 is divided in the conveyance direction T, on the basis of the amount of transmission of the region detected by the transmission amount sensor 19 to calculate the bond position where the bond part exists in the envelope sheet P2. It is noted that the bond position calculator 71 and the transmission amount sensor 19 may be configured to irradiate the envelope sheet P2 from the side of the bond part with light to calculate, as a detected sheet thickness, a thickness of each of the regions of the envelope sheet P2 on the basis of the light characteristics (for example, a reflectance spectrum) of the reflected light from the envelope sheet P2.

The judgment unit 72 is configured to judge whether or not the envelope sheet P2 is conveyed the correct way round from: the bond position calculated by the bond position calculator 71; and the bond position based on the enclosing and sealing settings concerning an enclosing and sealing job. For example, the judgment unit 72 judges whether or not the envelope sheet P2 is conveyed the correct way round on the basis of: the normal sheet thickness stored in the bond position storing part 83; and the detected sheet thickness calculated by the bond position calculator 71.

The device controller 73 is configured to control devices such as the envelope sheet feeder 23, the enclosure sheet feeder 15, the paper stop roller 17, the transmission amount sensor 19, the switch mechanism 37, the ROM 80, and the manipulation unit 60.

(Working of Enclosing and Sealing System)

Next, a description is given of the enclosing and sealing system 1 according to the embodiment of the present invention.

Figure 3:
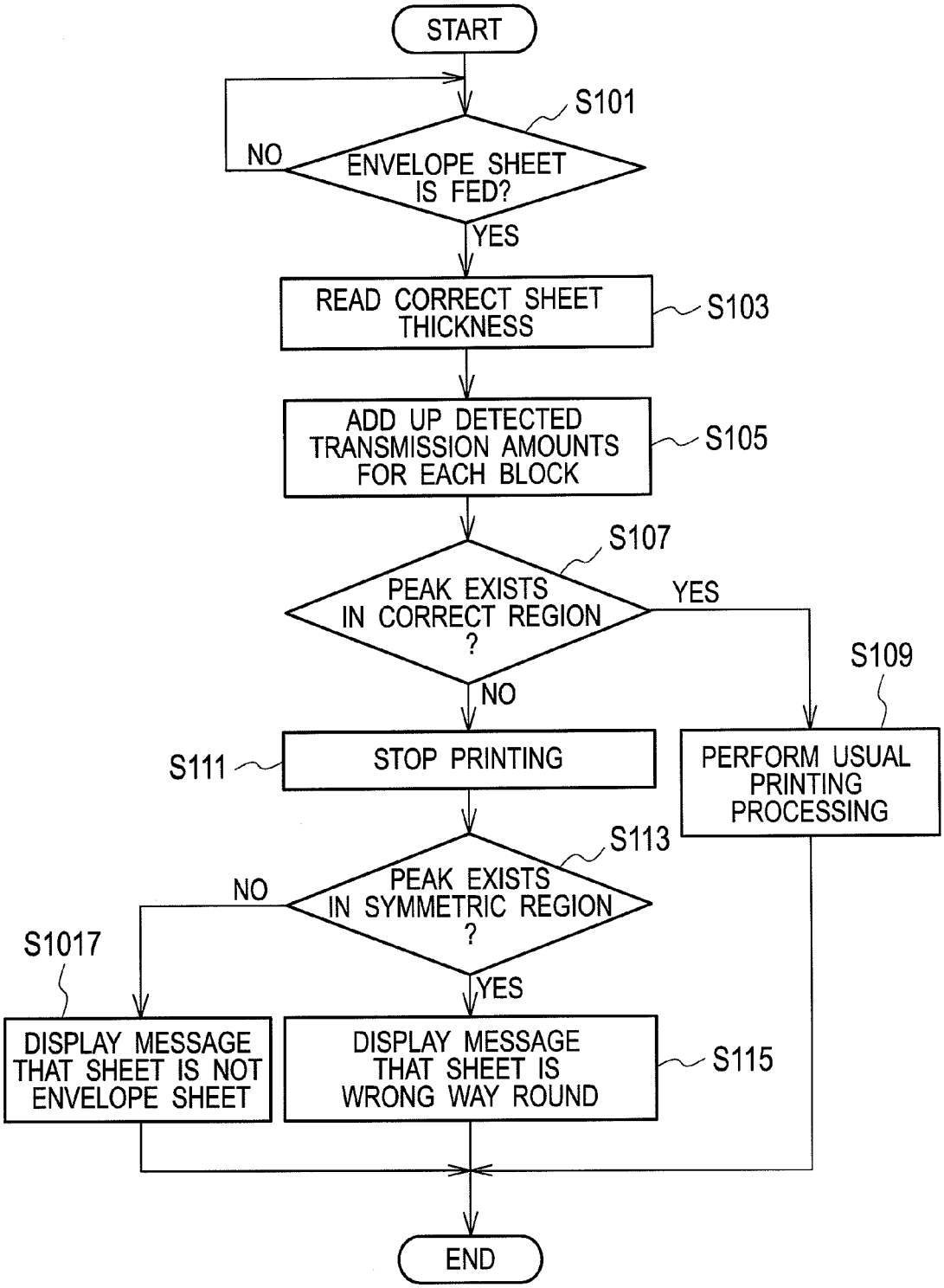
FIG. 3 is a flowchart showing procedures for processing in the image forming apparatus of the enclosing and sealing system according to the embodiment of the present invention.

FIG. 3 is a flowchart showing procedures for processing in the image forming apparatus 3 of the enclosing and sealing system 1 according to the embodiment of the present invention.

As shown in FIG. 3, the controller 70 of the image forming apparatus 3 judges whether or not an envelope sheet P2 is fed from the envelope sheet feeder 23 (Step S101).

If judging in Step S101 that the envelope sheet P2 is fed from the envelope sheet feeder 23, the controller 70 reads normal sheet thicknesses (Step S103). More specifically, the controller 70 reads, from the bond position storing part 83, the normal sheet thicknesses corresponding to the size of the fed envelope sheet P2.

Subsequently, the bond position calculator 71 of the controller 70 adds up the amounts of transmission detected by the transmission amount sensor 19 for each block, and thus calculates detected sheet thicknesses (Step S105). For example, in the case where an envelope sheet of the size of an envelope sheet P2 is divided into eight regions in the conveyance direction T, the bond position calculator 71 adds up the amounts of transmission detected in each divided region by the transmission amount sensor 19. Then, the bond position calculator 71 calculates the thicknesses of the envelope sheet P2 as the detected sheet thicknesses on the basis of the amounts of transmission thus added.

Figure 4A:
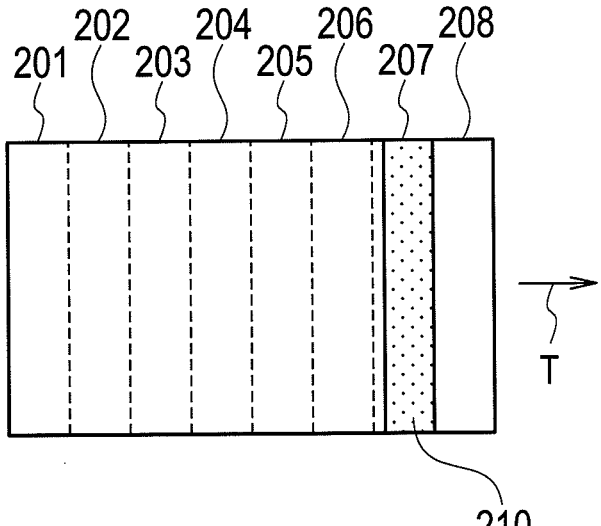
FIGS. 4A to 4D are diagrams showing an example of a normal sheet thickness and a detected sheet thickness in the enclosing and sealing system according to the embodiment of the present invention.
Figure 4B:
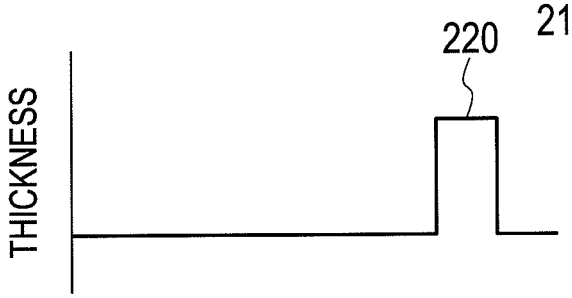
Figure 4C:
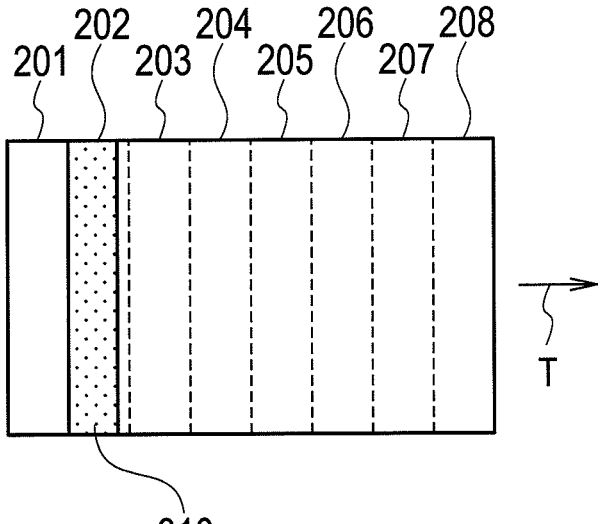
Figure 4D:
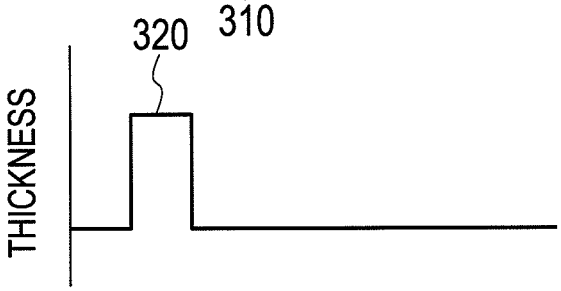

FIGS. 4A to 4D are views showing an example of a normal sheet thickness and a detected sheet thickness in the enclosing and sealing system 1 according to the embodiment of the present invention. FIG. 4A shows how an envelope sheet conveyed the correct way round is divided into regions; FIG. 4B shows a normal sheet thickness in the case of FIG. 4A; FIG. 4C shows how an envelope sheet conveyed the wrong way round is divided into regions; and FIG. 4D shows a detected sheet thickness in the case of FIG. 4C.

As shown in FIG. 4A, an envelope sheet of the size of an envelope sheet P2 is divided into eight regions in the conveyance direction T, i.e., divided regions 201 to 208.

The envelope sheet P2 of this size has a bond position 210 that falls within the divided region 207 so as to allow the enclosing and sealing apparatus 5 to enclose and seal the sheet normally.

Hence, such normal sheet thicknesses that a position corresponding to the divided region 207 has a larger thickness 220 as shown in FIG. 4B are stored in the bond position storing part 83.

On the other hand, as shown in FIG. 4C, an envelope sheet P2 conveyed the wrong way round is divided into eight regions in the conveyance direction T, i.e., divided regions 201 to 208, and has a bond position 310 located in the divided region 202.

Thus, as shown in FIG. 4D, the bond position calculator 71 adds up the amounts of transmission detected in each of the divided regions 201 to 208 by the transmission amount sensor 19. Then, the bond position calculator 71 calculates the thicknesses of the envelope sheet P2 as the detected sheet thicknesses on the basis of the amounts of transmission thus added. Since the bond position 310 exists in the divided region 202, such detected sheet thicknesses that a position corresponding to the divided region 202 has a larger thickness 320 are found.

As described above, since the detected sheet thickness of a bond part differs from the detected sheet thickness of a part other than the bond part, the bond position calculator 71 can calculate the bond position where the bond part exists in the envelope sheet P2 using the difference between the calculated detected sheet thicknesses.

Returning to FIG. 3, the judgment unit 72 of the controller 70 judges whether or not a peak exists in a correct region (Step S107). More specifically, the judgment unit 72 compares a detected sheet thickness of each region calculated by the bond position calculator 71 with a normal sheet thickness of the region stored in the bond position storing part 83. Then, if the detected sheet thickness and the corresponding normal sheet thickness are of the same thickness in every region, the judgment unit 72 judges that a peak exists in a correct region. By contrast, if any of the normal sheet thicknesses stored in the bond position storing part 83 is larger than the corresponding detected sheet thickness calculated by the bond position calculator 71, for example, the judgment unit 72 judges that no peak exists in the correct region.

If it is judged in Step S107 that a peak exists in the correct region (i.e., in the case of YES), the device controller 73 executes usual printing processing (Step S109). More specifically, the device controller 73 causes the printing unit 9 to carry out printing on the envelope sheet P2 and passes the printed enclosure sheet P1 and envelope sheet P2 to the enclosing and sealing apparatus 5 adjacent to the image forming apparatus 3.

On the other hand, if it is judged in Step S107 that no peak exists in the correct region (i.e., in the case of NO), the device controller 73 stops printing processing (Step S111). More specifically, the device controller 73 stops the printing processing on the envelope sheet P2 and discharges the enclosure sheet P1 and envelope sheet P2 to the paper discharge tray 34.

Then, the judgment unit 72 judges whether or not a peak exists in a symmetric region (Step S113). More specifically, if the detected sheet thickness calculated by the bond position calculator 71 is larger than the normal sheet thickness stored in the bond position storing part 83 in a region symmetrical against the center of the envelope sheet P2 in the conveyance direction T relative to the region where the normal sheet thickness is larger, the judgment unit 72 judges that a peak exists in the symmetric region.

In the example shown in FIGS. 4B and 4D, for example, a region symmetric in the conveyance direction T relative to the divided region 207 where the normal sheet thickness is larger is the divided region 202. Since the detected sheet thickness 320 calculated by the bond position calculator 71 is larger than the normal sheet thickness stored in the bond position storing part 83 in the divided region 202, the judgment unit 72 judges that the peak exists in the symmetric region.

Returning to FIG. 3, if it is judged in Step S113 that the peak exists in the symmetric region (i.e., in the case of YES), the device controller 73 displays a message indicating that the sheet is the wrong way round (Step S115). For example, the device controller 73 displays, on the display/input panel 61 of the manipulation unit 60, an error message saying "The position of the envelope sheet is abnormal. Set it in the reverse direction."

On the other hand, if it is judged in Step S113 that no peak exists in the symmetric region (i.e., in the case of NO), the device controller 73 displays a message indicating that the sheet is not an envelope sheet (Step S117). For example, the device controller 73 displays, on the display/input panel 61 of the manipulation unit 60, an error message saying "Set an envelope sheet."

As described above, the enclosing and sealing system 1 according to the embodiment of the present invention judges whether or not an envelope sheet P2 is conveyed the correct way round on the basis of normal sheet thicknesses stored in the bond position storing part 83 and detected sheet thicknesses calculated by the bond position calculator 71. Thereby, the enclosing and sealing system 1 can judge whether or not a bond position of the envelope sheet P2 is proper.

Thus, a message is displayed if the user sets an envelope sheet P2 to the envelope sheet feeder 23 the wrong way round, for example. This can prevent an envelope sheet P2 to be printed uselessly.

Note that, in the case where a position of a bond part of an envelope sheet P2 is stored in the bond position storing part 83, judgment on whether or not the envelope sheet P2 is conveyed the correct way round may be made by causing the bond position calculator 71 to calculate a bond position where the bond part exists in the envelope sheet P2 on the basis of the amounts of transmission detected by the transmission amount sensor 19, and by causing the judgment unit 72 to compare the bond position stored in the bond position storing part 83 and the bond position calculated by the bond position calculator 71.

Further, as described previously, the image forming apparatus 3 of the enclosing and sealing system 1 according to the embodiment of the present invention can carry out double-sided printing by causing the printing unit 9 to carry out printing on the front surface of each of an enclosure sheet P1 and an envelope sheet P2 and then by turning these sheets over on the switchback conveyance path 33 to cause the printing unit 9 to carry out printing on the back surface thereof. To be more specific, in the case where double-sided printing is carried out on the envelope sheet P2 according to the enclosing and sealing settings, the image forming apparatus 3 carries out printing on one surface of the envelope sheet P2 and then turns the sheet over to carry out printing on the other surface. For this reason, when placed on the paper feed tray, the envelope sheet P2 needs to be placed in such a manner that the position of a bond part (bond position) of the envelope sheet P2 is symmetric to the bond position in the case of single-sided printing.

Accordingly, in the case where double-sided printing is instructed in the enclosing and sealing settings, it is preferable to make judgment on whether or not an envelope sheet P2 is conveyed the correct way round before the printing unit 9 starts printing on the front surface of the sheet.

Figure 5A:
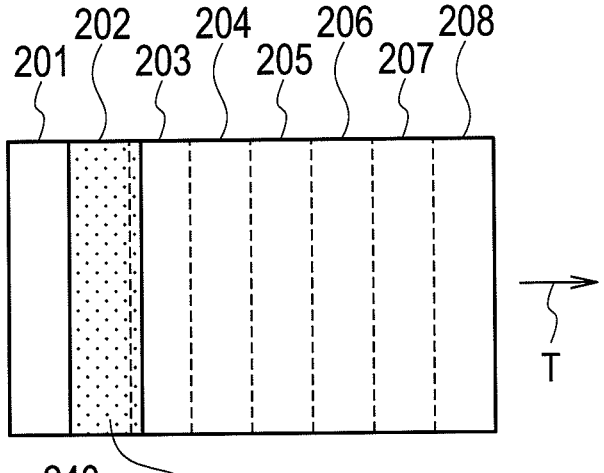
FIGS. 5A to 5D are views showing an example of a normal sheet thickness and a detected sheet thickness in the case of carrying out double-sided printing in the enclosing and sealing system according to the embodiment of the present invention.
Figure 5B:
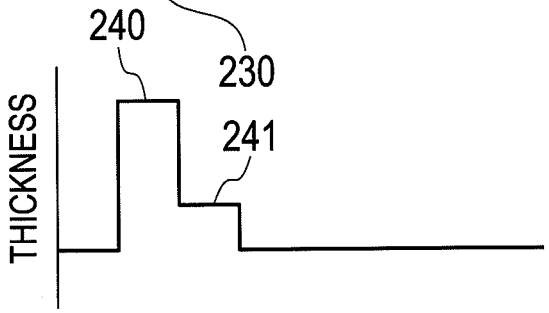
Figure 5C:
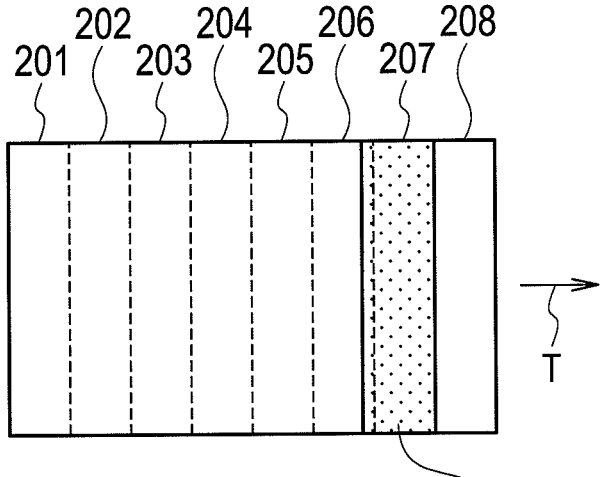
Figure 5D:
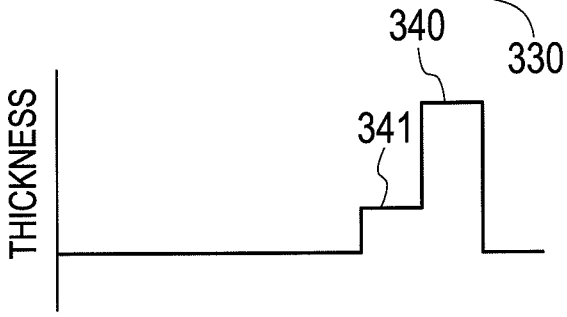

FIGS. 5A to 5D are views showing an example of a normal sheet thickness and a detected sheet thickness in the case of carrying out double-sided printing in the enclosing and sealing system 1 according to the embodiment of the present invention. FIG. 5A shows how an envelope sheet conveyed the correct way round is divided into regions; FIG. 5B shows a normal sheet thickness in the case of FIG. 5A; FIG. 5C shows how an envelope sheet conveyed the wrong way round is divided into regions; and FIG. 5D shows a detected sheet thickness in the case of FIG. 5C.

As shown in FIG. 5A, an envelope sheet of the size of an envelope sheet P2 is divided into eight regions in the conveyance direction T, i.e., divided regions 201 to 208.

The envelope sheet P2 of this size has a bond position 230 that falls within the divided regions 202 and 203 so as to allow the enclosing and sealing apparatus 5 to enclose and seal the sheet normally. Since an envelope sheet P2 is passed to the enclosing and sealing apparatus 5 after printing on the back surface of the sheet in double-sided printing, it is necessary to judge whether or not the envelope sheet P2 before reversal is the correct way round.

Hence, such normal sheet thicknesses for double-sided printing that positions corresponding to the divided regions 202 and 203 have larger thicknesses 240 and 241 as shown in FIG. 5B are stored in the bond position storing part 83.

If the envelope sheet P2 is conveyed the wrong way round as shown in FIG. 5C, a bond position 330 exists in the divided regions 206 and 207.

Thus, as shown in FIG. 5D, the bond position calculator 71 adds up the amounts of transmission detected in each of the divided regions 201 to 208 by the transmission amount sensor 19. Then, the bond position calculator 71 calculates the thicknesses of the envelope sheet P2 as the detected sheet thicknesses on the basis of the amounts of transmission thus added. Since the bond position 330 exists in the divided regions 206 and 207, such detected sheet thicknesses that positions corresponding to the divided regions 206 and 207 have larger thicknesses 340 and 341 are found. The envelope sheet P2 explained above is an envelope sheet to have the larger thicknesses 240, 241, 340, and 341 as detected sheet thicknesses. However, the present invention is not limited to this. For example, the envelope sheet P2 above may be an envelope sheet to have the larger thicknesses 240 and 340 as detected sheet thicknesses without the larger thicknesses 241 and 341.

In this way, it is possible to judge whether or not an envelope sheet P2 is conveyed the correct way round even in the case where double-sided printing is instructed in the enclosing and sealing settings.

It should be noted that the image forming apparatus 3 of the enclosing and sealing apparatus 5 according to the embodiment of the present invention is not limited to an ink-jet line color printer configured to carry out line-by-line printing, which is described in the embodiment as an example, and is also applicable to printing machines such as a serial ink-jet printer, a laser printer, and a stencil printing machine.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A sealing system for creating a sealed letter including an envelope sheet with at least one bond part, the sealing system comprising:

a transmission amount detector configured to detect an amount of transmission of the envelope sheet being conveyed on a conveyance path;

a bond position calculator configured to calculate a first bond position based on the amount of transmission detected by the transmission amount detector, the first bond position being a position on the envelope sheet where the at least one bond part is located; and a judgment unit configured to judge whether the envelope sheet is conveyed in a predetermined position relative to a conveyance direction of the envelope sheet, wherein the judgement unit judges whether the envelope sheet is conveyed in the predetermined position by comparing the first bond position, as calculated by the bond position calculator, with a second bond position, the second bond position being set based on a predetermined sealing setting.

2. The sealing system according to claim 1, wherein the bond position calculator is configured to calculate the first bond position by adding up amounts of transmission as detected by the transmission amount detector in each of regions into which the envelope sheet is divided in the conveyance direction.

3. The sealing system according to claim 1, wherein the judgment unit is configured to judge whether the second bond position and the first bond position are located in symmetrical positions against a center of the envelope sheet in the conveyance direction.

4. The sealing system according to claim 1, wherein calculating the first bond position based on the amount of transmission of the envelope sheet includes calculating a detected sheet thickness, the detected sheet thickness being calculated based on the amount of transmission, as detected by the transmission amount detector, of regions into which the envelope sheet is divided in the conveyance direction.

5. The sealing system according to claim 1, wherein the transmission amount detector irradiates the envelope sheet with one of light, infrared rays, and radial rays, and the transmission amount detector receives the one of light, infrared rays, and radial rays transmitted through the envelope sheet to detect the amount of transmission of the envelope sheet being conveyed on the conveyance path.

6. A sealing system for creating a sealed letter including an envelope sheet with at least one bond part, the sealing system comprising:

a transmission amount detector configured to detect an amount of transmission of the envelope sheet being conveyed on a conveyance path;

a controller; and a memory storing instructions that, when executed by the controller, cause the controller to perform operations including:

calculating a first bond position based on the amount of transmission detected by the transmission amount detector, the first bond position being a position on the envelope sheet where the at least one bond part is located; and judging whether the envelope sheet is conveyed in a predetermined position relative to a conveyance direction of the envelope sheet by comparing the first bond position with a second bond position, the second bond position being set based on a predetermined sealing setting.

7. The sealing system according to claim 6, wherein the first bond position is calculated by adding up amounts of transmission as detected by the transmission amount detector in each of regions into which the envelope sheet is divided in the conveyance direction.

8. The sealing system according to claim 6, wherein the memory storing further instructions that, when executed by the controller, cause the controller to judge whether the second bond position and the first bond position are located in symmetrical positions against a center of the envelope sheet in the conveyance direction.

9. The sealing system according to claim 6, wherein calculating the first bond position based on the amount of transmission of the envelope sheet includes calculating a detected sheet thickness, the detected sheet thickness being calculated based on the amount of transmission, as detected by the transmission amount detector, of regions into which the envelope sheet is divided in the conveyance direction.

10. The sealing system according to claim 6, wherein the transmission amount detector irradiates the envelope sheet with one of light, infrared rays, and radial rays, and the transmission amount detector receives the one of light, infrared rays, and radial rays transmitted through the envelope sheet to detect the amount of transmission of the envelope sheet being conveyed on the conveyance path.

* * * * *